US005666766A

United States Patent [19]

Markey

[11] Patent Number: 5,666,766

[45] Date of Patent: Sep. 16, 1997

[54] BUILDING CONSTRUCTIONS

[75] Inventor: Dennis P. Markey, Franklin, Mich.

[73] Assignee: Handy Home Products, Inc., Warren, Mich.

[21] Appl. No.: 529,132

[22] Filed: Sep. 15, 1995

[51] Int. Cl.[6] ..... E04B 7/00

[52] U.S. Cl. ..... 52/94; 52/92.3; 52/264; 52/639; 52/643

[58] Field of Search ..... 52/94, 90.1, 90.2, 52/91.1, 91.2, 91.3, 92.1, 92.2, 92.3, 639, 643, 264

[56] References Cited

U.S. PATENT DOCUMENTS

| | | | |
|---|---|---|---|
| 2,365,579 | 12/1944 | Mulligan | 52/639 X |
| 2,653,356 | 9/1953 | Brannon | 52/92.3 |
| 3,744,197 | 7/1973 | Wetzel, Jr. | 52/92.1 |
| 3,845,595 | 11/1974 | Abrams | 52/641 X |
| 4,051,641 | 10/1977 | Elliott | 52/92.1 X |
| 4,115,967 | 9/1978 | Kragt | 52/92.3 |
| 4,430,835 | 2/1984 | Ericson | 52/264 X |
| 4,481,744 | 11/1984 | Park . | |
| 4,573,292 | 3/1986 | Kaufman et al. . | |
| 5,293,725 | 3/1994 | Matticks et al. | 52/92.2 X |
| 5,375,381 | 12/1994 | Park et al. | 52/92.3 X |

*Primary Examiner*—Carl D. Friedman
*Assistant Examiner*—Winnie Yip
*Attorney, Agent, or Firm*—Harness, Dickey & Pierce, P.L.C.

[57] ABSTRACT

The present invention relates to building constructions which are relatively inexpensive and easy to assemble. Under a first embodiment, a building construction comprised of a lower portion and an upper portion wherein the lower portion includes a plurality of walls having a radially outwardly extending top plate which serves to support the upper portion of the building and assists in providing the building with an exaggerated eave is disclosed. Under a second embodiment, the building construction includes a plurality of inner and outer frame members wherein the outer frame members serve the additional function of a trim assembly. As the building constructions of the present invention are relatively easy to construct, the building constructions can be sold as a kit for construction by individuals having relatively little experience in the construction field.

8 Claims, 9 Drawing Sheets

BUILDING CONSTRUCTIONS

BACKGROUND AND SUMMARY OF THE INVENTION

The present invention relates to buildings including, for example, storage sheds and the like and, more particularly, to buildings generally constructed of wood which are relatively easy to construct. Under a first embodiment, the building includes a transversely extending top plate disposed along the upper edge of each wall which serves to support the upper portion of the building and provide the building with an enhanced eave construction. Under a second embodiment, the building includes a plurality of frame members wherein the outermost frame members serve as trim assemblies for the front and rear walls of the building.

While buildings such as storage sheds, huts, shanties, shelters and the like are known, many of the buildings which are currently available as prefabricated structures or are constructed from kits suffer from one or more perceived drawbacks which the present invention addresses. For example, many of the buildings which are in the form of kits or "ready to build" are constructed in large part from metal paneling which is considered to be less aesthetically appealing than wood structures. Additionally, many of the ready to build structures are unnecessarily complicated and require the use of an excessive number of tools to carry out the construction process. Perhaps the most important aspect of ready to build structures is their ease of construction so that persons of limited mechanical aptitude or craftsmanship can construct the building in a relatively short period of time. Further, to be useful, such buildings must be sturdy, be able to withstand a variety of weather conditions, and generally be capable of having a long life with minimum upkeep being required.

Accordingly, one object of the present invention is to provide a building assembly requiring a minimum of time and effort to build even if the builder has minimal mechanical aptitude or craftsmanship ability.

It is a further object of the present invention to provide buildings which are easy to construct yet are sturdy, weather resistant structures capable of a long life with a minimum amount of upkeep.

DETAILED DESCRIPTION OF THE PREFERRED EMBODIMENT

Figure 1:
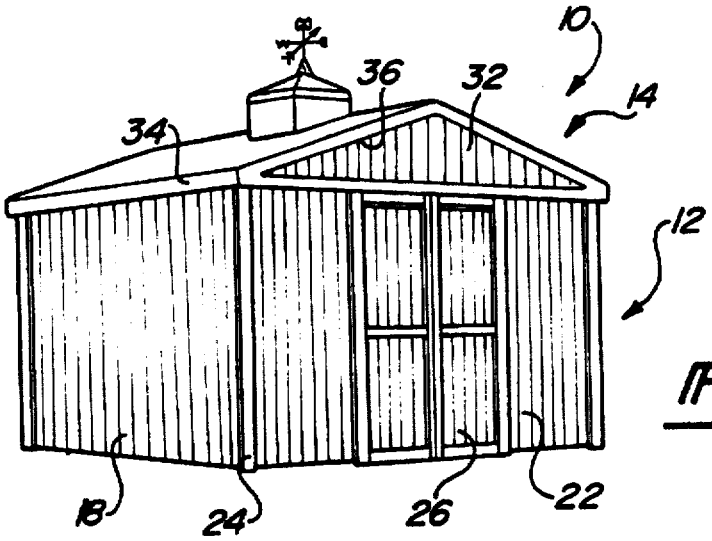
FIG. 1 is a perspective view of a building construction in accordance with the teachings of the present invention.

Referring to FIG. 1, there is shown a building in accordance with the teachings of the present invention. As illustrated, the building is essentially a wooden structure useful as a storage building or the like having dimensions of approximately eight feet in width and twelve feet in depth. As will be readily recognized, however, by those skilled in the art, the dimensions can be varied somewhat according to the end user's needs.

Ideally, the building 10 as shown in FIG. 1 comes in the form of a shed which can be readily assembled by simply following the prepared directions which are generally supplied with the materials for constructing the building.

Figure 9:
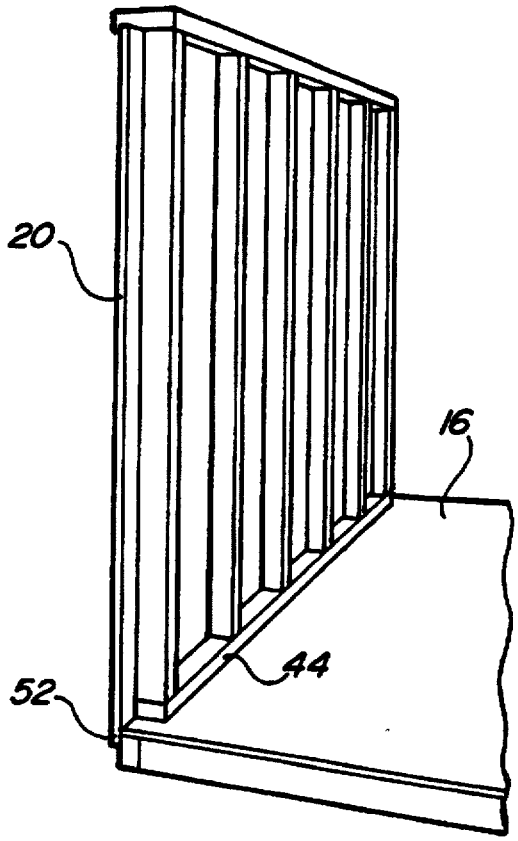
FIG. 9 is a rear perspective view of a rear wall attached to the floor assembly of the building in accordance with the teachings of the present invention.
Figure 12:
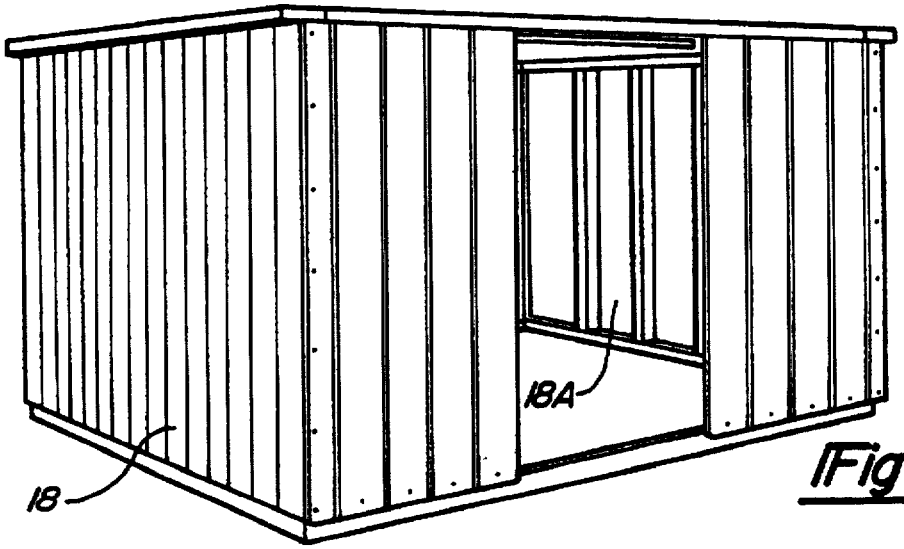
FIG. 12 is an assembled perspective view of the walls of the building attached to the floor assembly.

The building 10 can be best described in terms of a lower portion 12 and an upper portion 14. The lower portion generally includes a floor assembly 16 as shown in FIG. 9, two opposing side walls 18 and 18A as shown in FIG. 12, a rear wall 20 as shown in FIG. 9, a front wall 22, a plurality of corner trim pieces 24 and a door assembly 26.

Figure 13:
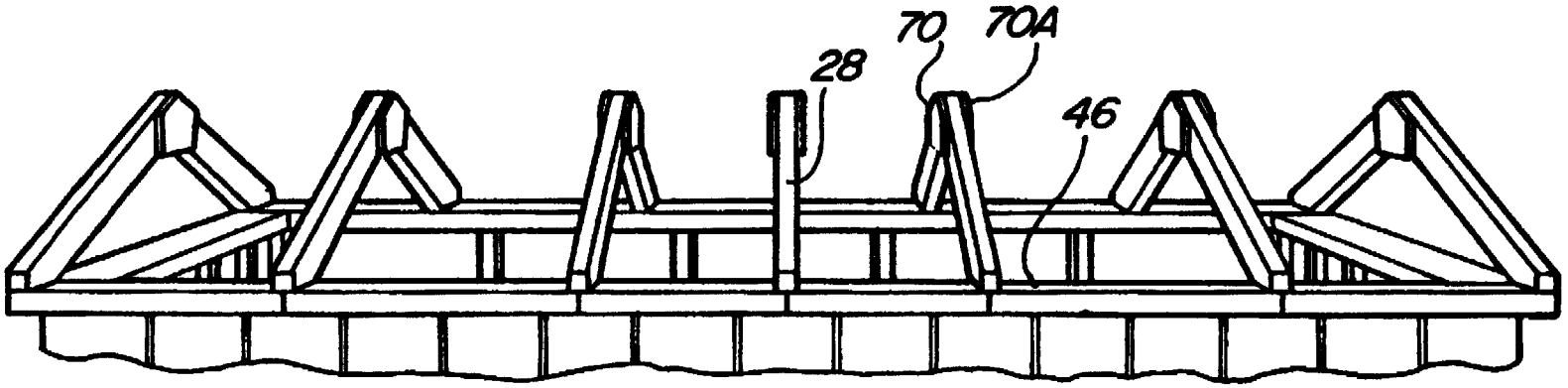
FIG. 13 is a perspective view of the truss assembly of the building in accordance with the teachings of the present invention.
Figure 14:
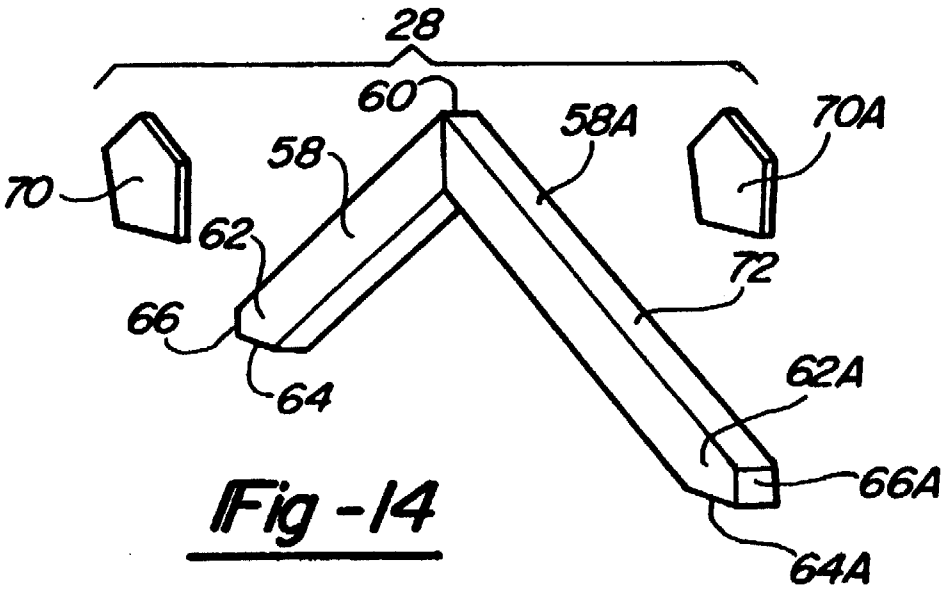
FIG. 14 is a blown apart perspective view of a truss of FIG. 13.
Figure 15:
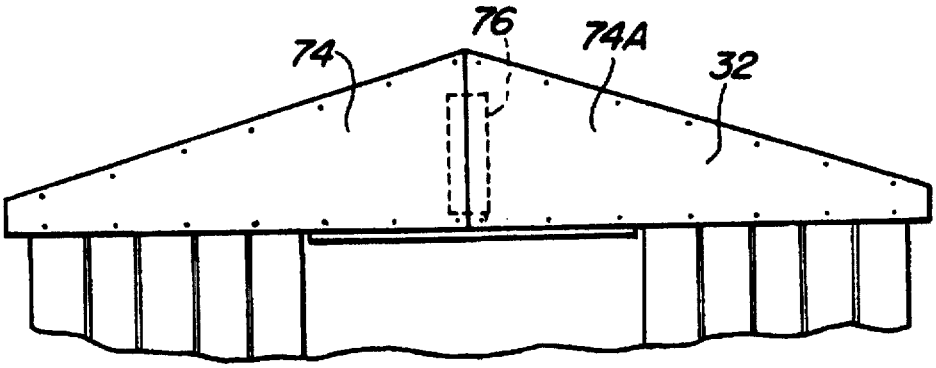
FIG. 15 is an end view of a gable used on the building in accordance with the teachings of the present invention.
Figure 16:
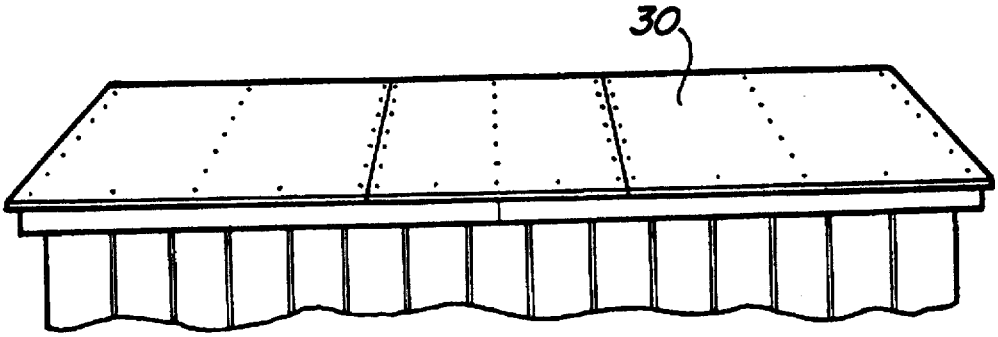
FIG. 16 is a side elevation view of the roof panels attached to the truss assembly of the building in accordance with the teachings of the present invention.
Figure 17:
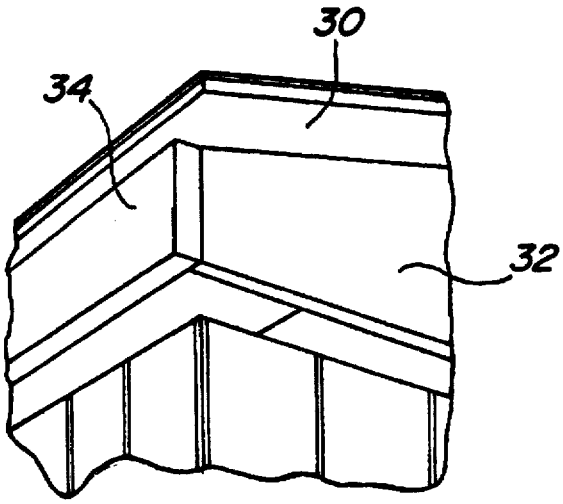
FIG. 17 is a perspective view of an upper corner of the building in accordance with the teachings of the present invention.
Figure 18:
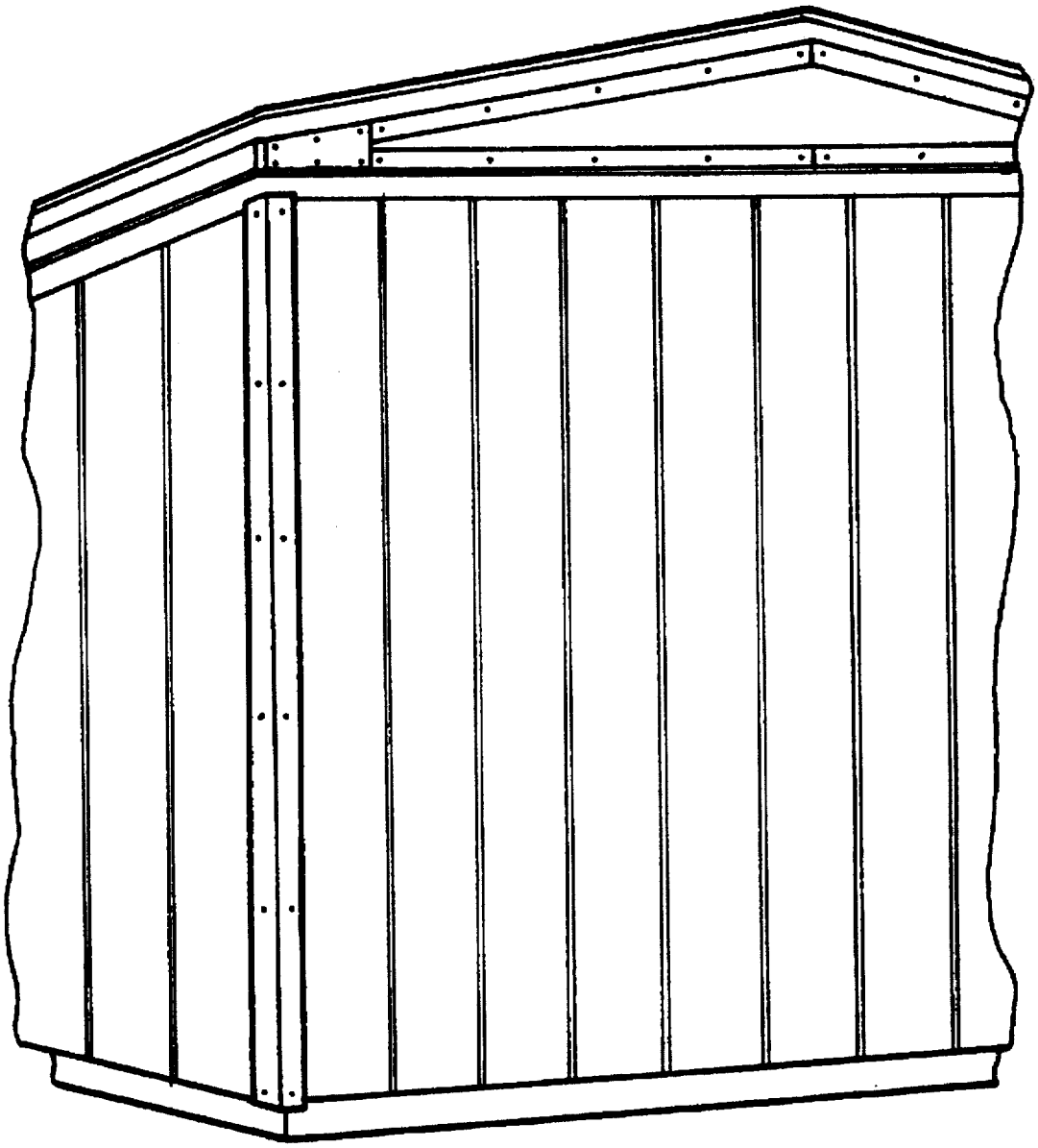
FIG. 18 is a perspective view of the building including trim pieces attached thereto for aesthetic enhancement.
Figure 19:
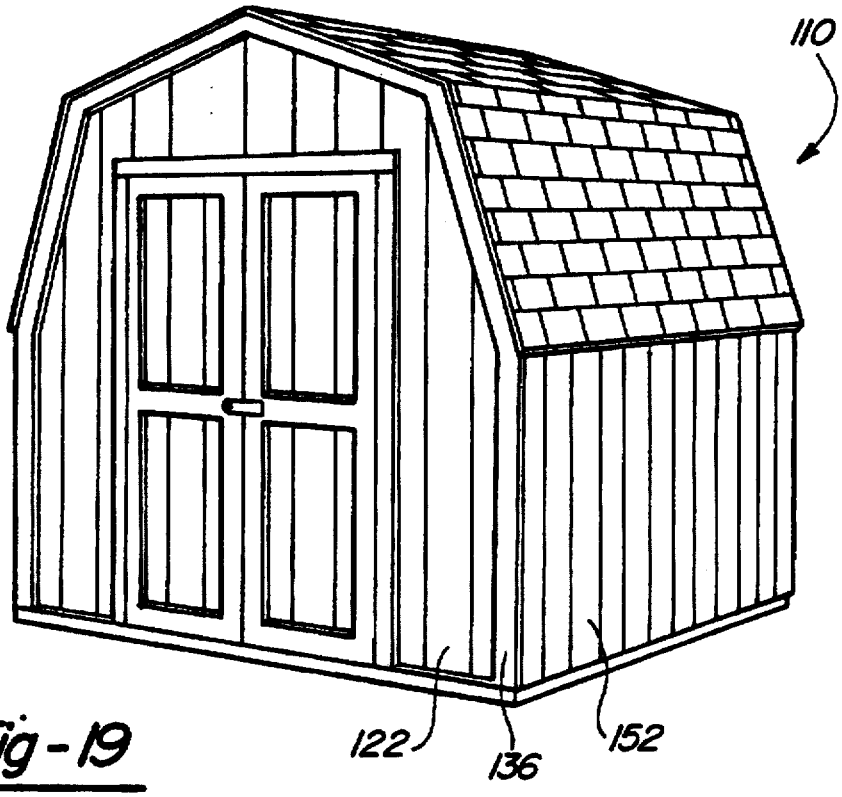
FIG. 19 is a perspective view of an alternative building construction in accordance with the teachings of the present invention.

The upper portion 14 generally includes a plurality of spaced apart trusses 28 as shown in FIGS. 13 and 14, one or more roof panels 30 as shown in FIG. 16, gables 32 as shown in FIG. 15 which are disposed at opposite ends of the building, side fascia 34 as shown in FIG. 17 which are disposed along both sides of the building, and a trim assembly 36 which can be utilized along one or both of the gables.

The floor assembly 16, which generally does not form part of the building kit when sold as such, includes a cement slab (not shown) and a floor overlay 38 to which the various walls of the building are attached as will be described in greater detail below. While the overlay 38 is generally made from wood or particle board, the floor overlay can realistically be made from a number of different materials so long as the walls of the building can be attached mechanically with fasteners such as nails.

Figure 2:
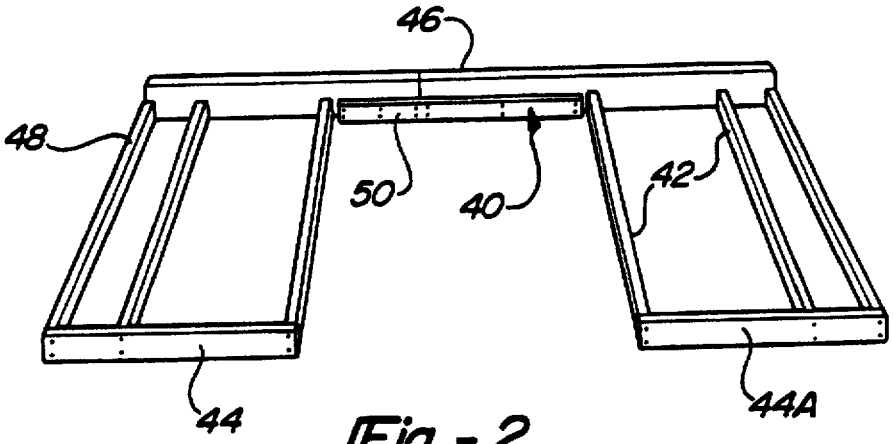
FIG. 2 is a side elevation view of a partially assembled front wall of the building in accordance with the teachings of the present invention.

The front wall 22 includes a frame 40 as shown in FIG. 2 constructed from a plurality of studs 42 which are preferably at least six feet in length, a bottom plate including first and second sections 44 and 44A which are attached perpendicularly to the studs along the lower ends thereof, and at least one top plate 46 which is attached perpendicularly to the studs along the upper ends thereof and parallel to the bottom plates. As with each of the walls, the top plate 46 is sized such that the top plate extends transversely beyond the outer edges 48 of the studs to assist in forming the exaggerated eave effect of the building. Without intending to be limited to a particular size, the bottom plates and studs may have a width of approximately three inches while the top plate has a width of approximately six inches for example.

As shown in FIG. 2, preferably the top plate 46 is formed from two sections joined end to end by a connector 50 which serves the added function of a door stop. By constructing the top plate from two relatively short separate sections, a reduction in the overall cost for the materials can be accomplished.

Figure 3:
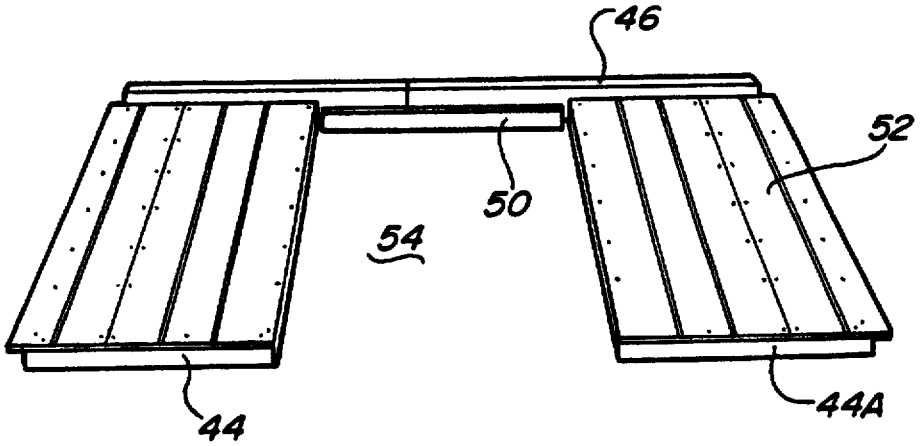
FIG. 3 is a side elevation view of the fully assembled front wall of FIG. 2.
Figure 4:
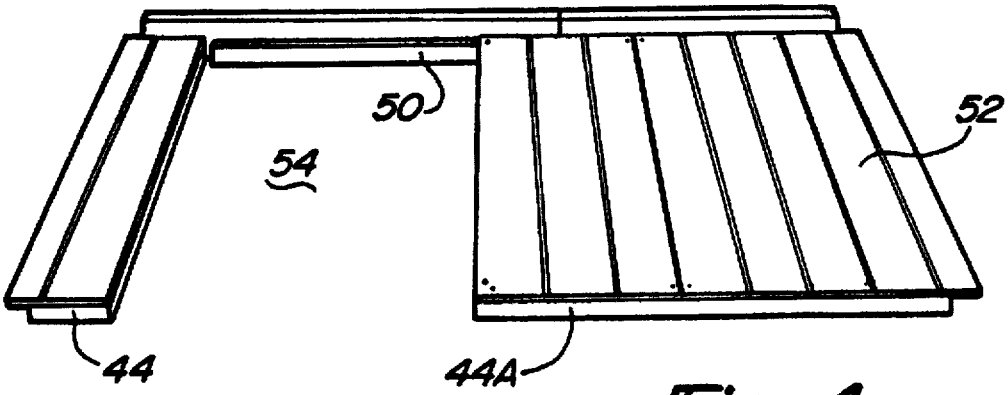
FIG. 4 is a side elevation view of an alternative front wall assembly.

Once the front wall frame 40 is constructed as illustrated in FIG. 2, a plurality of wall panels 52 are attached over the outer edges of the studs as shown in FIG. 3. Preferably, the wall panels 52 extend beyond the bottom plate sections 44 and 44A and the end studs, and are otherwise flush with the top plate and the studs defining the door opening 54. While the door opening 54 is shown at the center of the front wall, it should be noted that the door opening can be located along either side of the front wall as illustrated in FIG. 4, along a side wall or along the rear wall if desired. Further, it may be desirable to have doors along opposing walls of the building.

Figure 5:
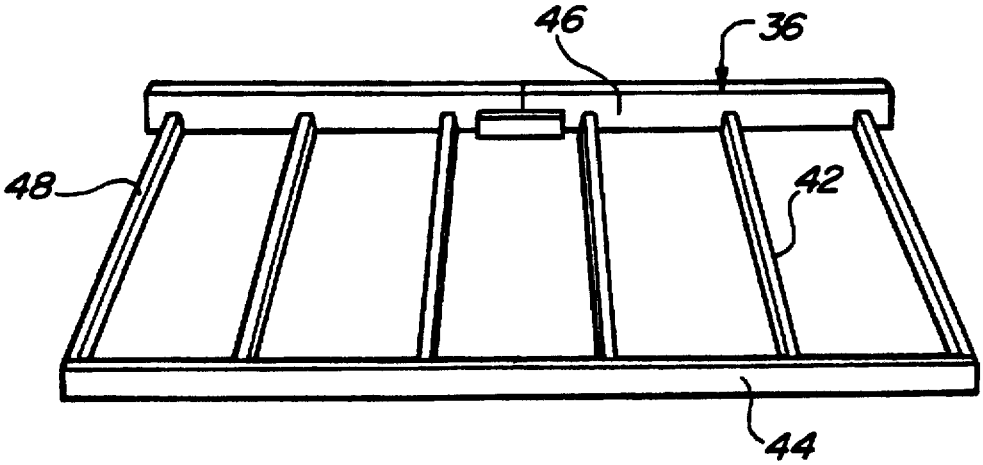
FIG. 5 is a side elevation view of a partially assembled side wall of the building in accordance with the teachings of the present invention.

Referring to FIG. 5, the construction of a side wall of the building 10 will now be described in greater detail. Since many of the components for each wall are substantially identical in terms of both feature and function, like reference numerals will be used to described like components of the walls throughout the remainder of the specification.

Figure 6:
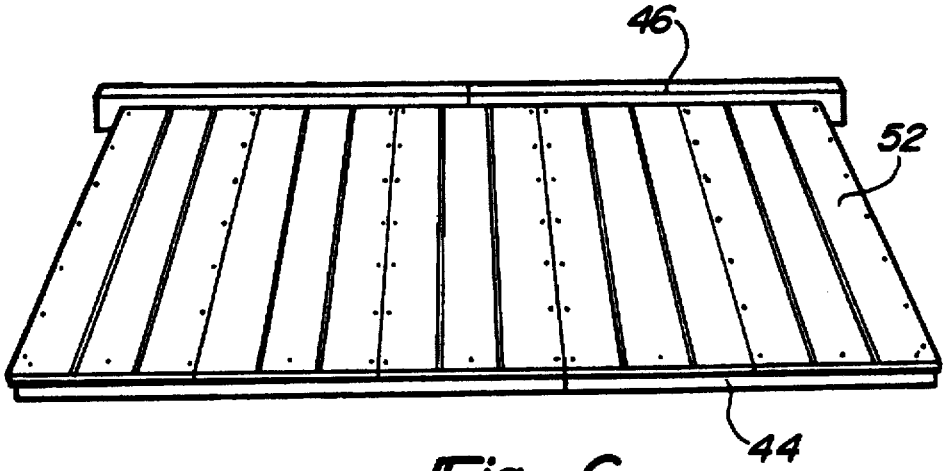
FIG. 6 is a side elevation view of the fully assembled side wall of FIG. 5.

As with the front wall, the side walls 18 and 18A, respectively, include a supporting frame 36 comprised of a bottom plate 44, a top plate 46 and a plurality of studs 42 extending therebetween. Ideally, each of the frame components will have the same overall width dimensions as the corresponding components of the front wall frame. Thus, the top plate 46 should extend transversely beyond the outer edges 48 of the studs as described above. Unlike the front wall, however, it is preferable that the top plate 46 extends beyond the end studs of the side wall frames to assist in joining the side walls flushly with the front wall as will also be described below. As shown in FIG. 6, the wall panels are attached over the outer edges of the studs such that the panels extend beyond the bottom plate and are otherwise flush with the end studs.

Figure 7:
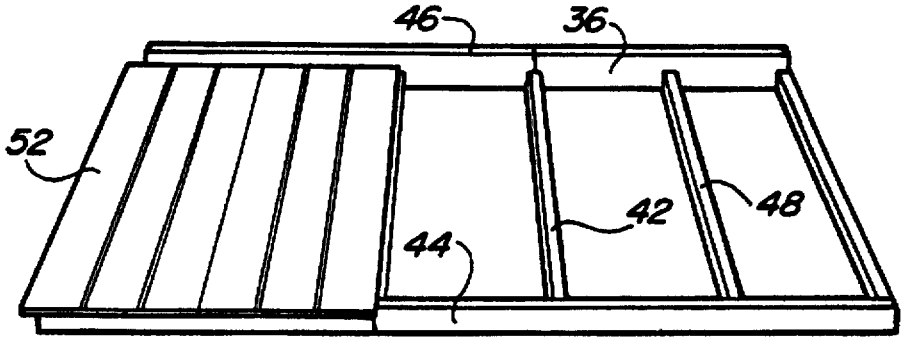
FIG. 7 is a side elevation view of a partially assembled rear wall of the building in accordance with the teachings of the present invention.
Figure 8:
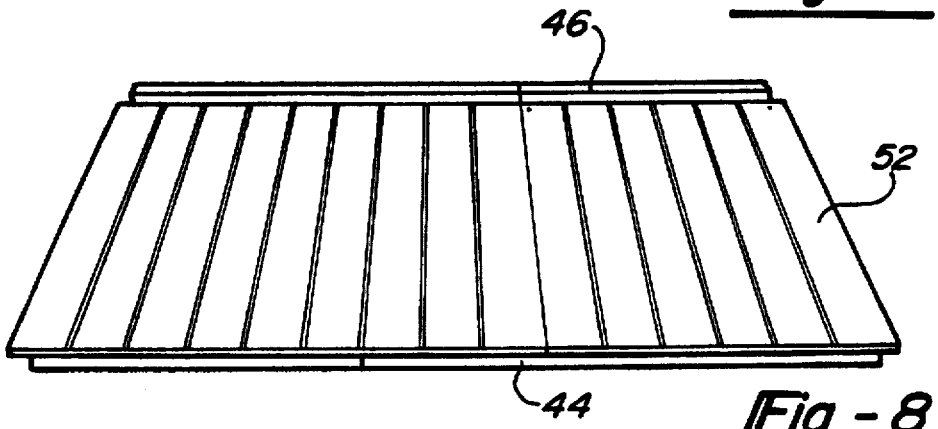
FIG. 8 is a side elevation view of the fully assembled rear wall of FIG. 7.

Referring to FIGS. 7 and 8, the rear wall 20 is shown to be constructed similarly to the front and side walls to include a frame 36 comprised of a top panel 46, a bottom panel 44 and a plurality of studs 42 extending therebetween and having a plurality of wall panels 52 attached over the outer edges 48 of the studs. Here, however, it is preferable that the wall panels 52 extend beyond the end studs and below the bottom plate as with the front wall 22. Preferably, the top and bottom plates 46 and 44, respectively, are flush with the end studs upon constructing the rear wall frame.

After assembling each of the walls, the walls are then attached to the floor to form the bottom portion 12 of the building. While the walls can generally be attached in any given order, for ease in construction, it is recommended that the rear wall 20 initially be erected by joining the wall to the floor assembly using a plurality of nails. The rear wall 20 is attached such that the bottom plate 44 comes to rest upon the floor itself and the wall panels abut the periphery of the floor assembly as shown in FIG. 9. While attaching the rear wall to the floor assembly, it may be desirable to utilize a removable brace (not shown) to support the wall while it is being erected.

Figure 11:
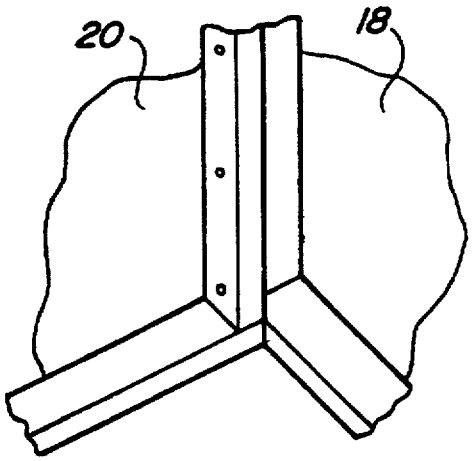
FIG. 11 is a perspective view of a side wall and rear wall attached to the floor assembly of the building in accordance with the teachings of the present invention.

Thereafter, the side walls 18 and 18A, respectively, are erected by attaching the walls to the floor assembly such that the bottom plates come to rest on the floor and the wall panels abut the periphery of the floor as described above. Upon erecting and attaching the side walls, the walls are positioned transversely to and contiguously against the rear wall 20 such that the comers are flush as shown in FIG. 11. To complete the lower portion of the building, the front wall 22 is attached to the floor assembly and the side walls as shown in FIG. 12. Upon erecting each of the walls, namely the front and rear walls as well as the side walls each of the walls extend upwardly from the floor assembly.

Figure 10:
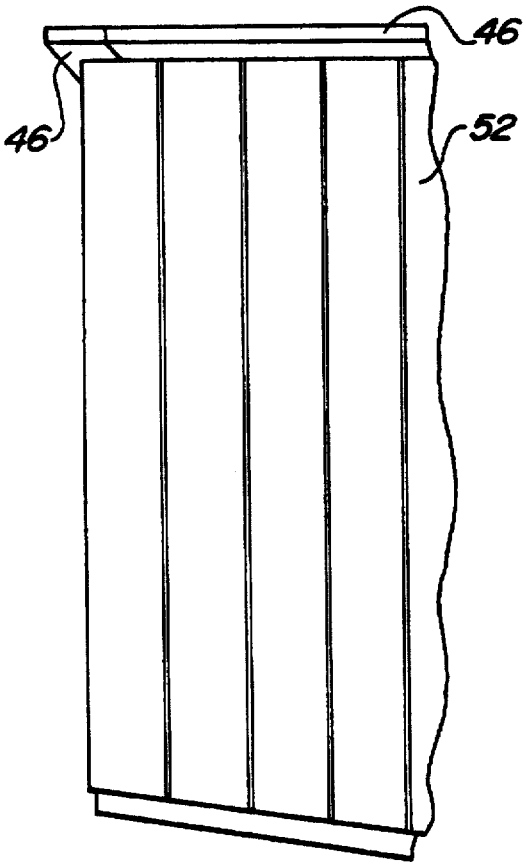
FIG. 10 is a perspective view of an upper corner assembly along two adjoining walls of the building in accordance with the teachings of the present invention.

As previously noted, an important aspect of the present invention is that the top plates of each of the walls are joined together and extend transversely from the respective walls as shown prominently in FIG. 10 to form a peripheral support for attachment of the top portion of the building. Thus, upon erecting the bottom portion of the building, the upper portion can be constructed.

The upper portion 14 of the building 10 in accordance with the teachings of the present invention is added to the building in the following manner. Initially, the trusses 28 are constructed by flushly adjoining two rafters 58 and 58A end to end as illustrated in FIG. 14 such that each truss includes a peak 60. The trusses 28 also include first and second terminal ends 62 and 62A which have planar lower edges 64 and 64A which are positioned flushly upon opposing sections of the top plate 46 for attachment thereto. Ideally, the outer edges 66 and 66A of each truss will be disposed at a right angle to the respective lower edge such that the outer edges 66 and 66A are flush with the outer edge 68 of the top plate as shown in FIG. 13.

Preferably, the trusses 28 are provided with one or more gussets 70 to assist in providing structural support to the upper portion of the building 12. Typically, a pair of gussets 70 and 70A are utilized on each side of the inner trusses and a single gusset is disposed on the inner side of the two outer trusses. The gussets 70 are generally pentagonally shaped such that each gusset is flush along the peak 60 and the upper edge 72 of the truss and extends between the rafters at the lower edge. Upon fastening the gussets to the trusses, the trusses are attached to the top plate in a spaced apart relationship as shown in FIG. 13. To fasten the trusses, a plurality of fasteners such as nails or the like are inserted through the terminal ends of the trusses and into the top plate.

After attaching the trusses as described above, end gables 32 are constructed and attached to the outer side of the two outer trusses. The end gables 32 as shown in FIG. 15 are typically formed by joining two frusto-triangular shaped panels 74 and 74A together end to end along the larger height dimensions to provide a substantially pentagonal shaped structure. As with the gussets 70, the gables 32 are also preferably attached to the trusses 28 so as to be flush along the peak 60 and the upper edge 72 of the respective truss. Optionally, a reinforcing slat as shown in dot and dash lines at reference numeral 76 of FIG. 15 can be attached along the inner surface of each gable between the gable panels for additional reinforcement.

The next step in the construction process of building 10 is the attachment of one or more roof panels 30 along the outer edges 72 of the trusses. The roof panels 30 should preferably overhang the gables along both the front and the sides as shown most clearly in FIG. 17. Upon fastening the roof panels utilizing a plurality of nails or other such fasteners, the side fascia 34 are attached to extend between the front and rear gables.

As a final step in the construction of the top portion 14, a trim assembly 36 is applied along the outer surface 80 of the gables. The trim assembly 36 generally includes first and second abutting slats 82 and 82A disposed along the top edge 84 of the gables' outer surface. Thereafter, end trim pieces 84 and 84A, respectively, which generally have a trapezoidal configuration are attached along the terminal ends 86 and 86A of the slats 82 and 82A, respectively, such that the inner edge 88 of the end trim pieces 84 and 84A are contiguous with the terminal end of the slats. Upon attachment of the end trim pieces, the outer edge 90 of each end trim piece is preferably flush with the corresponding end of each respective fascia 34 to provide the building with a well finished appearance.

As should be understood by those skilled in the art, the building 10 can thereafter be sealed along any and all seams with a commercially available caulking compound and, thereafter, painted, stained or varnished to provide the building with an added measure of aesthetic appeal. Still further, shingles can be applied to the roof panels and corner trim strips 24 as shown in FIG. 1 can be attached to the corners provided along the lower portion.

Figure 20:
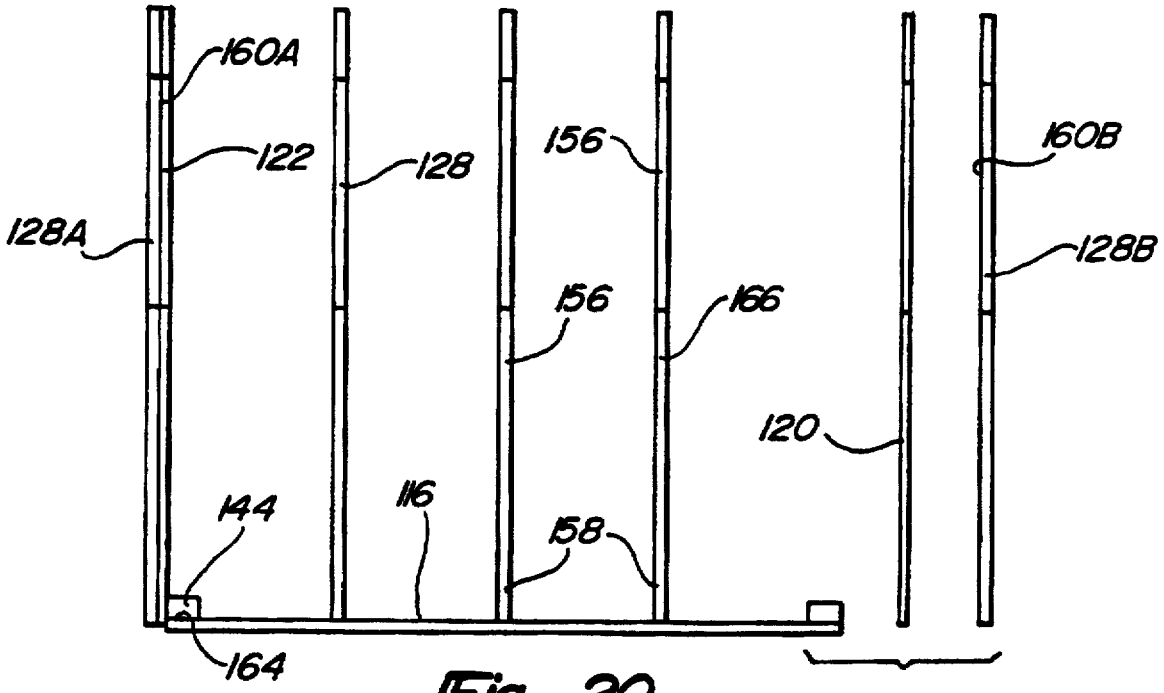
FIG. 20 is a side elevation view of the building of FIG. 19 illustrating the frame members of the building.

Now, referring to FIGS. 19–23, an alternative building construction in accordance with the teachings of the present invention is illustrated. The building 110 generally includes a floor assembly 116 as shown in FIG. 20, a plurality of frame members 128, a front wall 122, a rear wall 120, a plurality of wall and ceiling panels 152 extending between the front and rear walls and supporting members 144 for attaching the front and rear walls indirectly to the floor assembly. It should be noted that the front and rear walls are also commonly referred to herein as first and second end walls.

Figure 21:
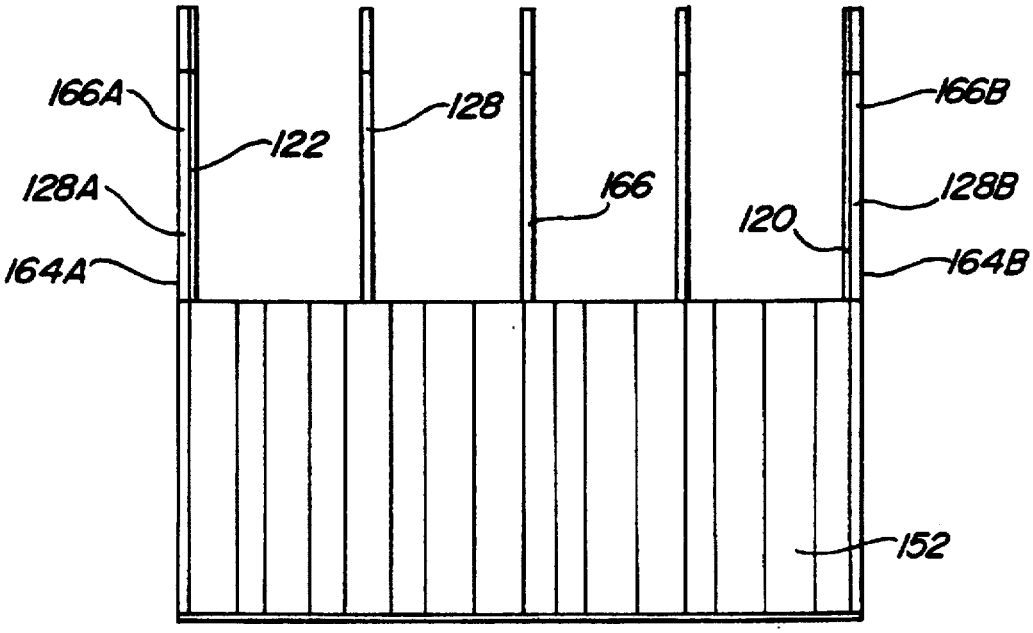
FIG. 21 is a side elevation view of the building of FIG. 19 illustrating the wall panels being applied over the frame members.
Figure 22:
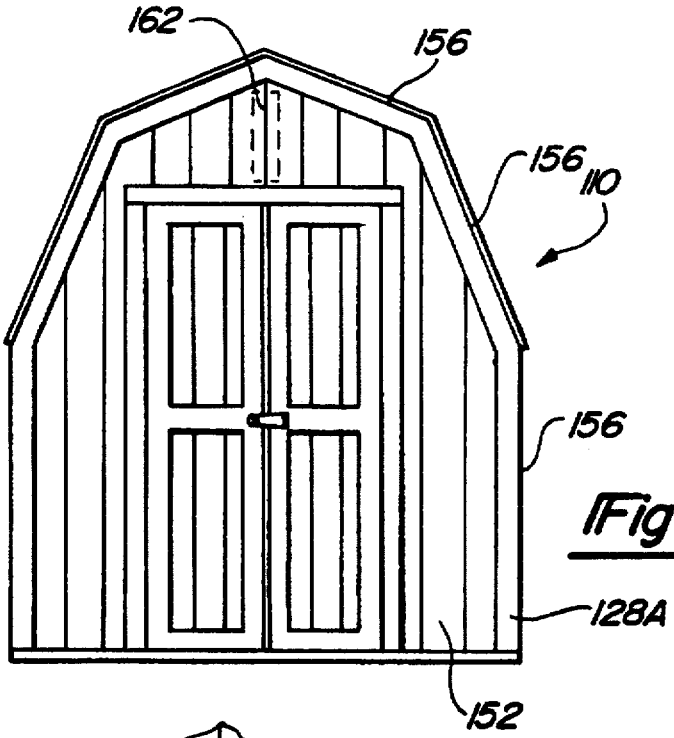
FIG. 22 is a front view of the building showing the front wall formed from two sheets of material.

Referring to FIGS. 20–22, the frame members 128 including both the inner frame members, hereinafter referred to by reference numeral 128 and outer frame members 128A and 128B, have a substantially inverted U-shape as best shown in FIG. 22 including a plurality of linear sections 156. The inner frame members 128 are fastened directly to the floor assembly by nailing or otherwise fastening the terminal ends 158 of the frame members to the floor assembly. As with the building 10 of FIGS. 1 through 18, the inner and outer frame members may also be two-piece constructions including one or more gussets at the peak.

The outer frame members 128A and 128B respectively serve as the trim assembly 136 along both the front and rear walls. In this regard, it should be noted that the front wall 122 is fastened along the inner surface 160A of the first outer frame member 128A and the rear wall 120 is fastened along the inner surface 160B of the second outer frame member 128B.

It should be noted at this point that the front and rear walls or end walls, may be one piece configurations pre-cut to the dimensions of the first and second outer frame members or may be in the form of multiple sections which are joined together as illustrated in FIG. 22 by line 162 end to end as previously described with regard to the gables of the first building 10.

Figure 23:
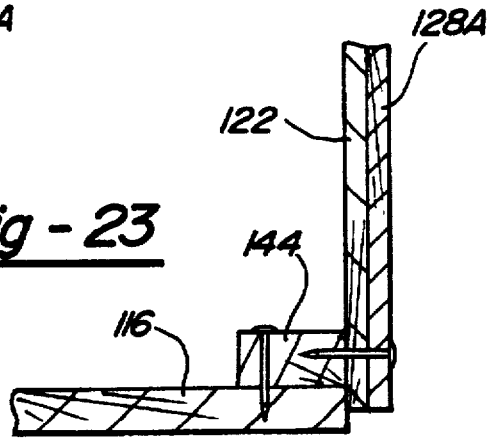
FIG. 23 is a section view illustrating the front wall panel being attached to a support member which assists in load reinforcement of the building.
Figure 24:
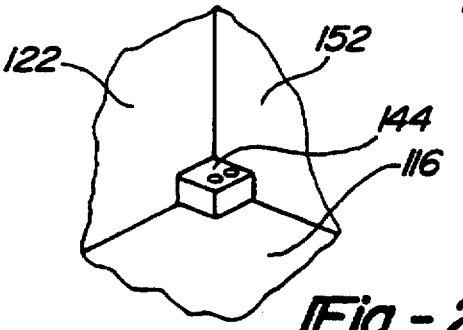

To attach the front and rear walls 122 and 120, respectively, supporting members 144 are attached along the corners 164 of the floor assembly as shown in FIGS. 20 and 23. The supporting members are preferably in the form of truncated wooden studs capable of sustaining a portion of the weight of front and rear walls.

The supporting members 144 are first fastened to the floor assembly as shown in FIG. 23 utilizing a plurality of nails or other similar fasteners and thereafter, the front and rear walls are attached to the respective studs by fasteners such as nails being driven through both the outer frame members 128A and 128B and the corresponding front and rear walls 122 and 120, respectively.

Once the front and rear walls are attached indirectly to the floor as described above, the wall and ceiling panels 152 can be attached along the various linear sections 156 along the outer edge 166 of the inner frame members and along the outer edges 166A and 166B of the front and rear walls. In order to obtain the flush fit of the panels 152 to the outer edges 164A and 164B of the outer frame members, the outer frame members have a larger outer dimension than the inner frame members to accommodate for the thickness of the wall and ceiling panels.

As with the building 10, the building 110 in accordance with the teachings of the present invention should thereafter be sealed along any and all seams with a caulking compound and, thereafter, painted, stained or varnished. Still further, shingles or additional trim work may be provided to further enhance the aesthetic characteristics of the present invention.

While the above description constitutes the preferred embodiments of the present invention, it is to be appreciated that the invention is susceptible to modification, variation and change without departing from the proper scope and fair meaning of the accompanying claims.

What is claimed is:

1. A building construction comprising:

a floor assembly including side and end edges;

a plurality of inner frame members attached substantially along the side edges of said floor assembly;

first and second end walls being supported substantially along said end edges of said floor assembly, at least one of said first and second end walls being spaced from said inner frame members;

at least one outer frame member including an inner surface attached to an external surface of one of said respective end walls of the building for substantially supporting said end wall to the building;

at least one said panel extending between said first and second end walls and attached to said inner frame members and to at least one of said respective end walls and said outer frame member.

2. The building construction according to claim 1, further comprising at least one support member providing means for attaching said at least one outer frame member indirectly to said floor assembly, said support member being disposed on and fastened to said floor along said at least one end edge of said floor assembly, said at least one end wall and combined outer frame member being fastened to said support member.

3. The building construction according to claim 2, wherein a support member is utilized along each corner of the floor assembly.

4. A building construction comprising:

a floor assembly including side and end edges;

at least one inner frame member attached to opposite sides of said side edges of said floor assembly;

a plurality of side walls extending between said end edges of said floor assembly and attached to side surfaces of said at least one inner frame member on said opposite sides of said floor assembly; and at least one end wall substantially attached to one of said end edges of said floor assembly and spaced from said at least one inner frame member, an outer frame member attached to an outer surface of said end wall for substantially supporting the end wall wherein said side walls are attached to at least one of said end wall and said outer frame member.

5. The building construction of claim 4, further comprising a support member fastensred to said floor assembly to which said end wall is attached.

6. The building construction of claim 5, wherein said support member is in the form of an essentially truncated stud.

7. The building construction of claim 4, wherein said at least one end wall includes first and second opposing end walls including outer frame members.

8. The building construction of claim 4, wherein said at least one end wall includes at least two wall panels attached end to end along a largest height dimension.

* * * * *

UNITED STATES PATENT AND TRADEMARK OFFICE

CERTIFICATE OF CORRECTION

PATENT NO. : 5,666,766

DATED : September 16, 1997

INVENTOR(S) : Dennis P. Markey

It is certified that error appears in the above-indentified patent and that said Letters Patent is hereby corrected as shown below:

Col. 4, line 56, "building 12" should be --building 10--

Col. 6, line 62, claim 1, "said" (1st occurrence) should be --side--

Col. 8, line 7, claim 5, "fastensred" should be --fastened--

Signed and Sealed this

Third Day of March, 1998

Bruce Lehman

*Attest:*

BRUCE LEHMAN

*Attesting Officer*

*Commissioner of Patents and Trademarks*